United States Patent [19]

Simpson

[11] 3,952,799

[45] Apr. 27, 1976

[54] APPARATUS FOR BOREHOLE DRILLING

[75] Inventor: Harry Elwood Simpson, Dallas, Tex.

[73] Assignee: Dresser Industries, Inc., Dallas, Tex.

[22] Filed: Oct. 24, 1974

[21] Appl. No.: 517,661

[52] U.S. Cl. ..... 166/116; 166/180; 166/187

[51] Int. Cl.[2] ..... E21B 33/12; E21B 33/127

[58] Field of Search ..... 166/115, 116, 179, 180, 166/188, 191, 202, 187, 89

[56] References Cited

UNITED STATES PATENTS

| | | | |
|---|---|---|---|
| 7,479 | 1/1877 | Fox | 166/187 |
| 597,316 | 1/1898 | Durprou | 166/180 |
| 2,451,762 | 10/1948 | Millikan | 166/187 |
| 2,675,878 | 4/1954 | MacGregor | 116/202 |
| 2,778,431 | 1/1957 | Lynes | 166/188 |
| 2,852,284 | 9/1958 | Bryson | 277/58 |
| 3,172,476 | 3/1965 | Voliva | 166/202 |
| 3,511,512 | 5/1970 | Wheelock | 277/58 |
| 3,516,679 | 6/1970 | Schmitt | 277/58 |
| 3,760,878 | 9/1973 | Peevey | 166/202 |

*Primary Examiner*—James A. Leppink
*Attorney, Agent, or Firm*—Michael J. Caddell

[57] ABSTRACT

Apparatus is disclosed for borehole drilling which provides a pressure-tight seal between the drill pipe and the borehole or casing. The apparatus uses resilient elements between the borehole and the body portion of the drilling head. The resilient elements may be engaged in sealing engagement in the borehole by hydraulic or air inflation.

3 Claims, 9 Drawing Figures

APPARATUS FOR BOREHOLE DRILLING

BACKGROUND OF THE INVENTION

This invention is generally for use in the drilling of boreholes and is specifically suited for the drilling of boreholes and piling foundation holes in cold regions such as Alaska and Canada.

In the past, the apparatus utilized to seal between the drill pipe and the borehole wall when drilling boreholes or pile foundation holes involved the use of a flat plate with a hole therethrough. The flat plate is slipped over the drill pipe and pressed against the ground over the borehole annulus.

This suffers from the disadvantage of a poor seal against both the ground and the drill pipe, especially when the ground is rough or uneven, frozen, or rocky. Also the seal against the drill pipe is poor since the plate must give the pipe room to flex and move slightly to prevent wear between the pipe and the plate.

The present invention overcomes these disadvantages by providing a drilling head which is flexible enough to conform to the borehole profile and allow the drill pipe movement yet still provide a good seal.

DESCRIPTION OF THE PREFERRED EMBODIMENTS

Figure 1:
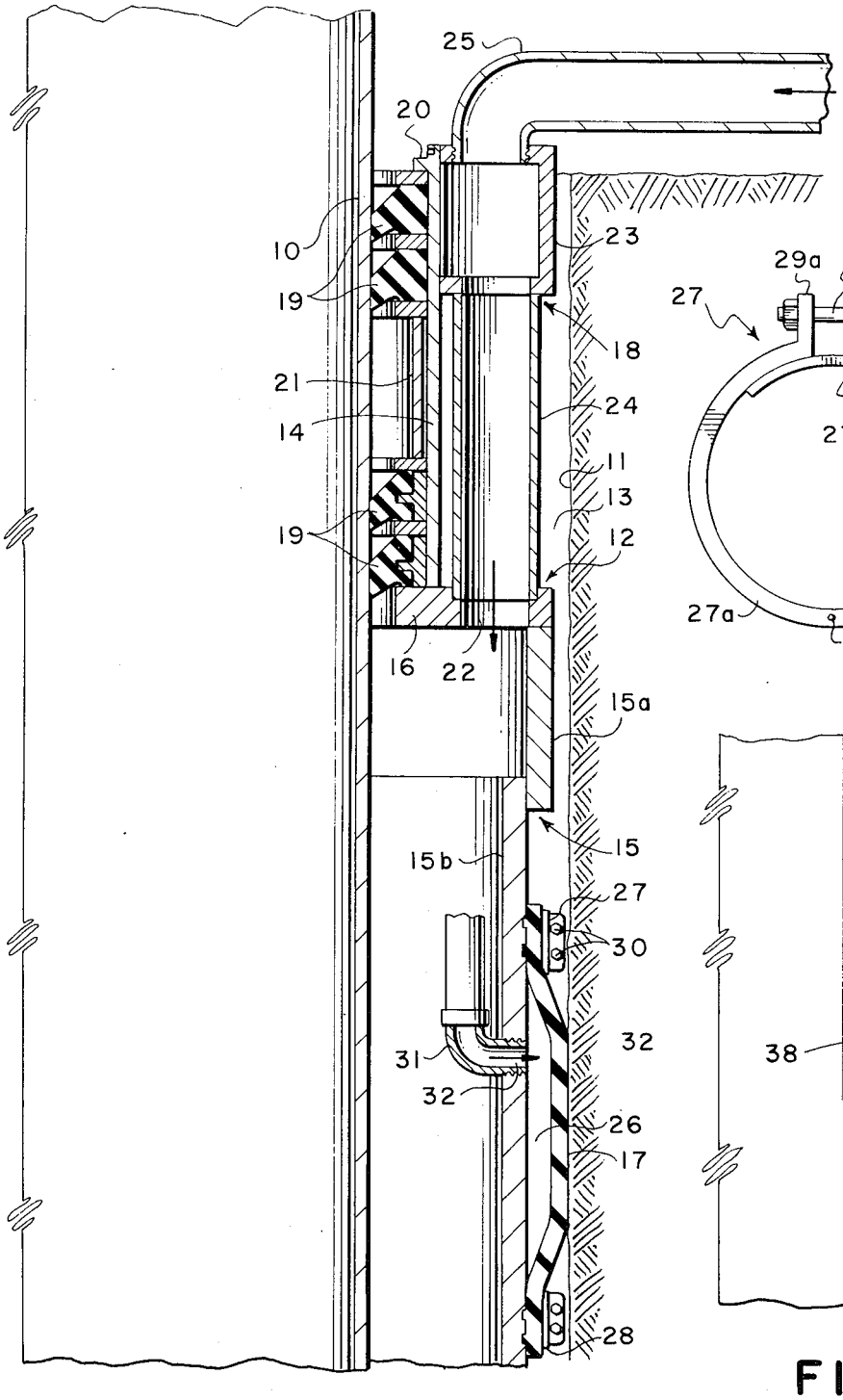
FIG. 1 illustrates in cross-section a one-half view of the sealing apparatus.

Referring to FIG. 1, a drill pipe 10 is rotatably suspended in a borehole 11. An inflatable drilling head 12 is suspended in the annulus 13 between the drill pipe and the borehole by a strut (not shown) connected to the drilling rig floor.

The drilling head 12 comprises an upper tubular housing 14, a lower tubular housing 15 connected to housing 14 by passage ring 16, inflatable annular seal envelope 17, and fluid pressure supply system 18.

Tubular housing 14 is located concentrically about the drill pipe 10 in telescoping relationship and contains therein annular, resilient, drill pipe seal lips 19. Lips 19 are secured to the inside of housing 14 by inwardly projecting ears or ring 20 and ring 16. A tubular spacing sleeve 21 is located between the upper and lower lips to maintain their spaced relation.

Passage ring 16 is an annular plate-like ring attached to the lower end of housing 14 by means such as welding and having a plurality of air passage channels 22 passing vertically therethrough.

An annular manifold chamber 23 is formed outside the upper portion of housing 14 and communicates through passages 22 by a plurality of vertical flow tubes 24 passing therebetween.

A pressure supply line 25 provides a source of the pressurized medium to manifold 23.

Lower housing 15, for convenience of manufacture, has an upper tubular section **15*a* and a lower tubular section 15*b* joined together by means such as welding. Upper section 15*a* is also welded to the outer portion of ring 16**.

Figure 1A:
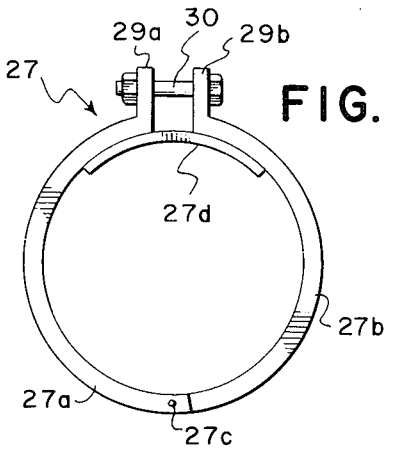
FIG. 1A shows a top view of the ring clamps used in the apparatus.

An annular inflatable seal envelope 17 passes circumferentially around lower section **15*b* and forms a pressure-tight chamber 26 therein. Envelope 17 may comprise an elastomeric sheath held to the housing 15 by upper and lower ring clamps 27 and 28. FIG. 1A illustrates a top view of the ring clamp 27 each having semicircular sections 27*a* and 27*b* hinged at pin 27*c*. Each section has projecting flanges 29*a* and 29*b* through which pass bolts 30 joining the hinge together and supplying a clamping function. The gap between flanges is closed by an arcuate bridge plate 27*d* to prevent bulging and/or extrusion of the seal element 17 therethrough. The construction of ring clamp 28 is similar to that of clamp 27**.

A pressure supply conduit 31 is connected in port 32 to provide inflation pressure to the inflatable envelope 17 from an independent source at the surface.

Figure 1B:
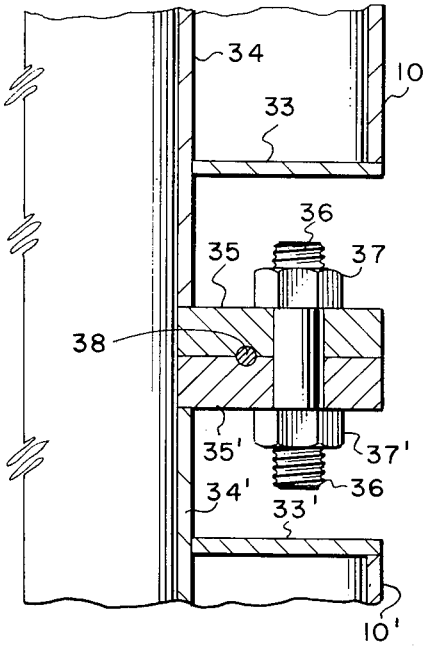
FIG. 1B illustrates in cross-section a method of connecting pipe sections.

FIG. 1B illustrates a typical joint connection of drill pipe used in drilling piling foundation holes in northern regions. The drill pipe 10 is attached at each end to an annular, inwardly projecting flange 33 which encircles and is connected to an inner string of conduit 34. The inner string, in turn, is connected by means such as welding to an outwardly projecting annular flange 35 having a plurality of bolt holes therethrough spaced evenly around the annular flange to receive bolts 36 upon which is threaded nuts 37. The upper end of the next lower drill pipe section 10' is similar to the lower end of section 10 allowing the joining together of the two sections at their mating flanges by bolts 36 and nuts 37 and 37'. An o-ring gasket 38 provides a seal between the mated flanges. Other types of seals could be used such as flat flange gaskets.

Figure 2:
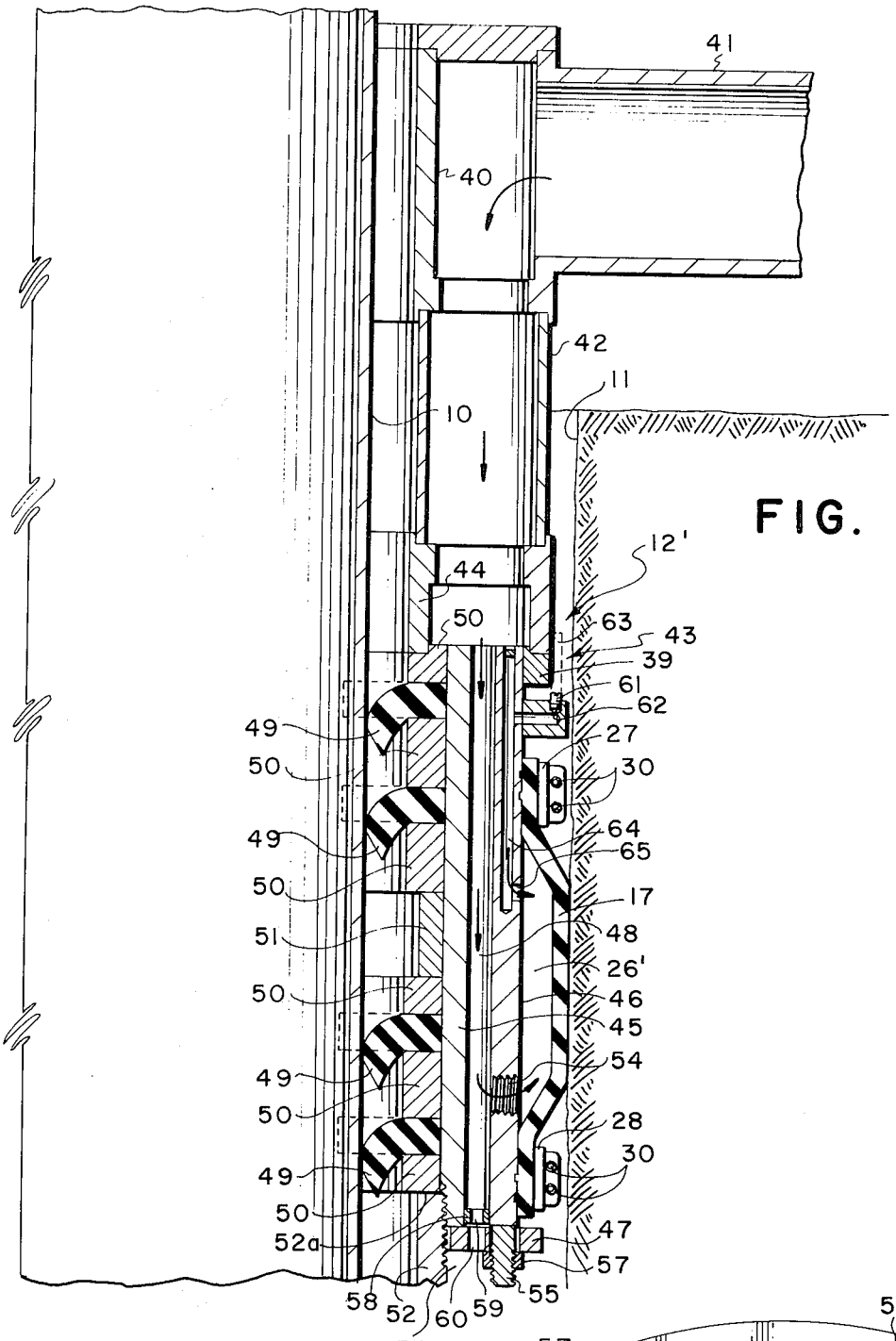
FIG. 2 illustrates an alternate embodiment to the apparatus of FIG. 1.

FIG. 2 illustrates another embodiment of the invention in which the inflatable envelope 17 is inflated by the same pressurized fluid used in the drilling operation.

In these type drilling operations in frozen areas, a pressurized fluid such as air is supplied at high volumes down the annulus during the drilling. A vacuum is maintained in the inner passage of the drill string to supplement the pressurized flow down the annulus and carrying with it cuttings and drillings from the drill face. The vacuum is achieved by placing a high, mechanically induced suction on the inner bore of the drill string at the surface by means known in the art.

Alternately, rather than injecting pressurized air into the outer annulus, it can be injected down the annulus between the inner drill pipe string 34 and the outer string 10 by providing some means of passage around flanged joints 35 such as ports or tubes. The use of the inflatable seal 17 would be similar under this mode of operation requiring only a blocking of openings 22 in plate 16 and relocation of air supply conduit 25.

In FIG. 2 an annular manifold 40 is suspended above the borehole outside the drill pipe 10 by a strut (not shown) connected to the drilling rig floor. A fluid supply line 41 is connected to the manifold 40 to supply pressurized fluid thereto. A plurality of air supply tubes 42 lead downward from manifold 40 to an orifice assembly 43.

Assembly 43 comprises an air flow reception chamber 44 receiving tubes 42, tubular inner seal housing 45, tubular outer seal housing 46, and lower orifice plate 47. Inner housing 45 is concentrically and coaxially located inside housing 46 to provide an annular passage 48. An outer circular ring 39 is attached to the lower end of chamber 44 to provide a portion of the bottom of the chamber.

A plurality of inwardly projecting annular seal lips 49 are clamped inside inner housing 45 by circular clamping sleeves 50 in longitudinal axial abutment with the lips. A central spacer sleeve 51 divides the sealing lips into upper and lower groups. Abutment of the uppermost ring 50 with the wall of chamber 44 and abutment of lowermost ring 50 with shoulder 52*a* of lower cylinder 52 provides the clamping of seal lips 49 in place.

Seal lips 49 are shown in their unflexed state in phantom lines on FIG. 2 and, when placed around drill pipe 10, take on the flexed configuration shown in solid lines in the figure. These lips provide a pressure-tight seal against the drill pipe.

Annular passage 48 going from chamber 44 to the annulus 53 below the drilling head 12' has one or more ports 54 through the wall of housing 46 to provide pressurized fluid to expand resilient envelope 17 against the borehole wall 11, much the same way as it was actuated in the embodiment of FIG. 1. In this configuration, the pressurized air from line 41 and suction on drill pipe 10 moves a large volume of air through line 41, manifold 40, chamber 44, and annular flow passage 48. An adjustable annular orifice plate 47 is held to the lower end of passage 48 by threaded studs 55 attached to the lower end of housing 46, projecting through curved slots 56, and containing threaded nuts 57 thereon. Nuts 57 secure the orifice plate on the studs and are threaded down tight on the plate to clamp it to the housings 45 and 46. An annular ported ring 58 is held snugly in the lower end of annular passage 48 and has ports 59 therethrough.

Figure 2A:
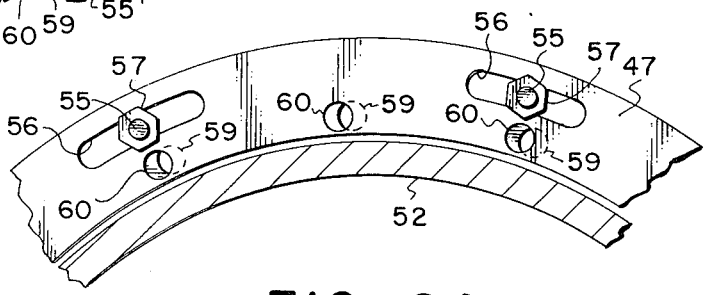
FIG. 2A illustrates an axial view of a portion of the apparatus of FIG. 2.

A close-up view of the orifice plate 47, looking upward from below the plate, is shown in FIG. 2A. The annular ring 58 blocking the lower end of passage 48 has a plurality of ports 59 evenly spaced therearound, shown in phantom in FIG. 2A. Ports 60 through orifice plate 47 are designed to align with ports 59 and allow fluid flow downward from passage 48.

Curved slots 56 allow rotation of the orifice plate 47 to open or close the porting arrangement 59 and 60. Nuts 57 can be loosened to move the orifice plate to the desired port opening and then, retightening of the nuts will lock the orifice in place.

OPERATION

The drilling seal of FIG. 1 is supported from the drilling rig platform by a strut, not shown in the figure. The drill pipe runs inside the flexible seals 19 and is sealingly rotatable therein. Air pressure is supplied through line 25 and a vacuum is placed on the inner bore of the drill pipe. Air pressure works through manifold 23, flow tubes 24, and into the annulus to carry cuttings from the rock face up the drill pipe.

A pressurized fluid such as air is simultaneously supplied by independent means through conduit 31 and port 32 to the inflation chamber 26 inside resilient member 17 which maintains it inflated outward against the borehole wall 11. The resiliency of member 17 may be varied by the operator to account for differing wall surface smoothness from one borehole to the next. The element 17 is easily changed while the drilling head is out of the borehole by the loosening of the two ring clamps 27 and 28.

Maintenance of the fluid pressure inside chamber 26 provides a highly efficient annular seal in the borehole which prevents the pressurized air supplied to the annulus from escaping back up the annulus to the surface.

In FIG. 2 the drilling seal is actuated by the placement of the adjustable orifice plate at the bottom of air passage 48 to establish a differential pressure thereacross. This differential pressure acts through ports 54 and inflates the element 17 into sealing engagement with the borehole wall.

Alternatively, should the available differential pressure be insufficient to obtain proper inflation of the seal 17, a threaded plug 61 may be removed from internally threaded port 62 and a supplemental air pressure supply line shown in phantom at 63 may be threaded therein. Pressurized air may then be injected via line 63 and port 62 into an internal wall passage 64 and through port 65 into the inflation chamber 26'. A plug (not shown) may be threaded into each of ports 54 to prevent loss of inflation pressure from chamber 26'.

SECOND EMBODIMENT

Figure 3A:
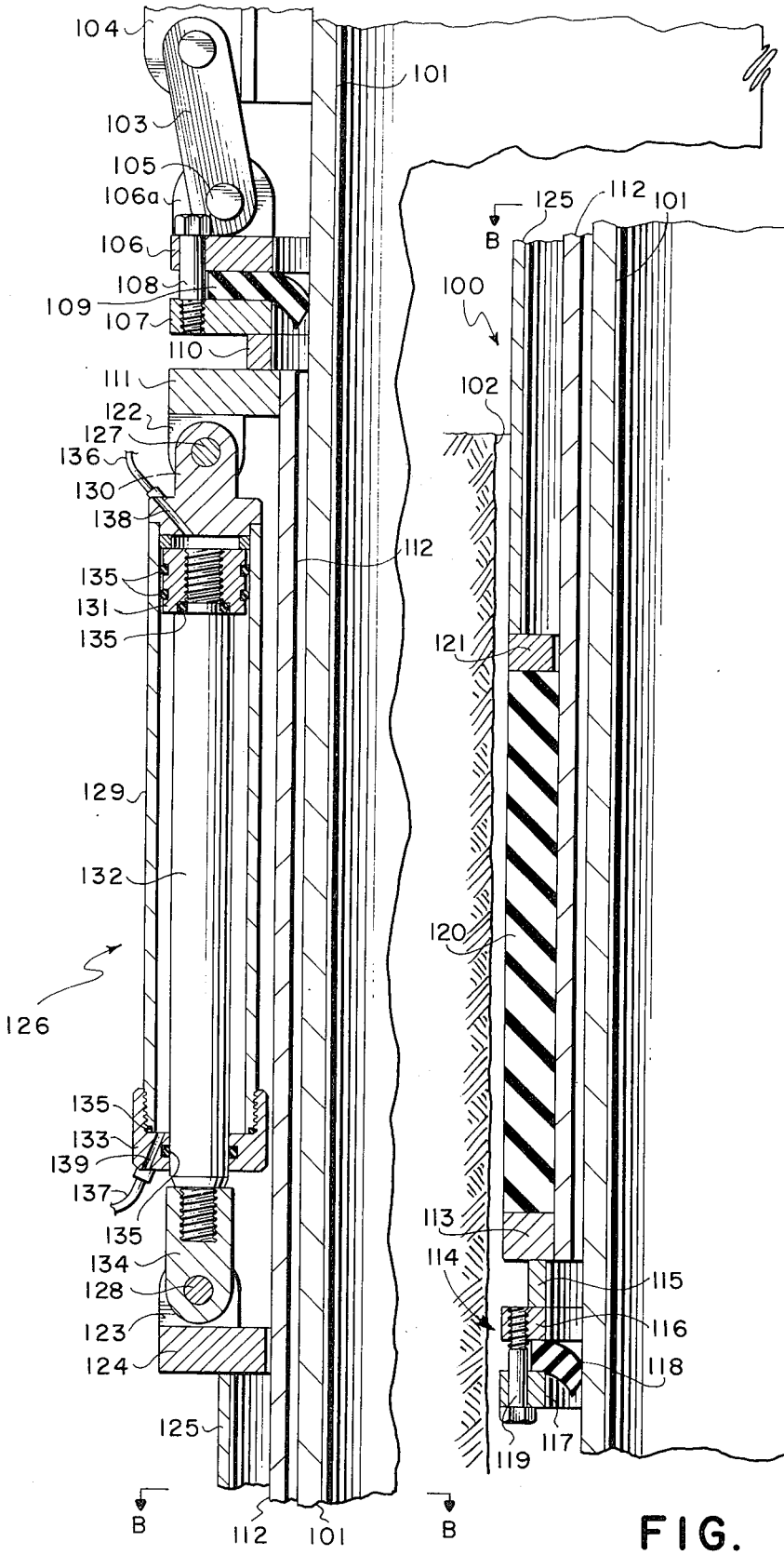
FIG. 3A and 3B illustrate in cross-section a one-half view of a compressible sealing element.
Figure 3B:
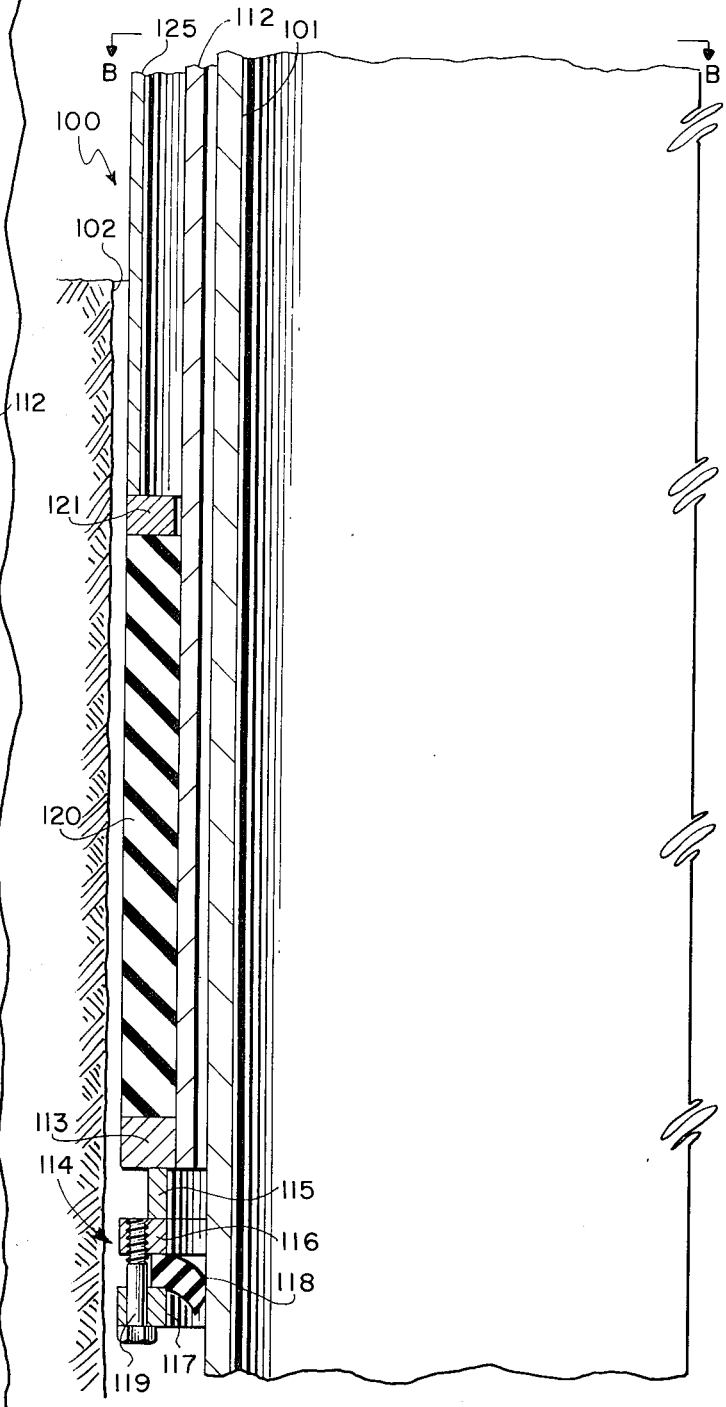

FIGS. 3A and 3B illustrate another embodiment of a drilling seal utilizing hydraulic piston means to engage the sealing element in the borehole which device is especially suited where air pressure and induced vacuum are not utilized.

The drilling seal 100 is located around a section of drill pipe 101 in a borehole 102. The seal assembly 100 is supported from the rig floor by one or more pinned struts 103 attached to the floor at hinge ears 104. Struts 103 are hingedly attached via pins 105 to the upper flange ring 106 of the seal assembly.

Ring 106 is a flat circular ring having vertically extending upper flanges 106*a* to which are pinned struts 103. A lower ring 107 is located in spaced parallel relationship below ring 106 and is clamped thereto by a plurality of transverse bolts 108 passing through ring 106 and threaded into ring 107.

A circular, inwardly extending, annular resilient seal element 109 is securely held between rings 106 and 107 by their bolted arrangement and is arranged to make sealing contact with drill pipe 101 causing flexure of the seal as illustrated.

The above described upper drill pipe seal assembly is attached via a spacer ring 110 to an upper drive carrier ring 111 which is a flat annular plate. Ring 111 is securely attached to the outer upper portion of the seal main carrier sleeve 112 which is an elongated tubular cylindrical member.

At the lower outer end of sleeve 112 is attached the lower main-seal compression shoulder 113 which is a circular ring attached to the sleeve. Attached to the lower main-seal shoulder 113 is the lower auxiliary drill pipe seal assembly 114 comprising a short cylindrical connecting sleeve 115, upper clamping ring 116, lower clamping ring 117, and annular resilient sealing lip 118, and a plurality of spaced bolts 119 passing through rings 116 and 117 and sealing lip 118.

Bolts 119 pass through holes in the lower ring 117 and seal 118 to threadedly engage in upper ring 116. Tightening of bolts 119 clamps the two rings together, securely gripping annular seal 118. The seal is arranged to sealingly engage the drill pipe, causing flexure of the seal as illustrated.

An axially compressible, radially expandible, resilient sealing sleeve 120 is located snugly but slidably around the carrier sleeve 112 and abuts atop seal shoulder 113. An upper circular compression ring 121 encircles sleeve 112 and rides atop the main-seal sleeve 120.

A plurality of evenly spaced downward facing lugs 122 are secured to the bottom of carrier ring 111 and an equal number of similarly spaced upwardly facing lugs 123 are secured to top surface of an intermediate circular ring 124 encircling sleeve 112 in slidable relationship. A cylindrical drive sleeve 125 is attached to the lower side of ring 124 and the upper surface of compression ring 121.

One or more hydraulically actuated piston-cylinder drive assemblies 126 are hingedly attached by pins 127 and 128 to lugs 122 and 123, respectively. The drive assemblies are double acting hydraulic piston and cylinder arrangements having an outer cylinder 129 pinned to upper lug 122 by pin 127 passing through cylinder flange 130.

Inside cylinder 129 is a reciprocating piston 131 in slidable sealing engagement therein, securely mounted on piston rod 132 which extends through lower cylinder cap 133 and contains threadedly thereon a piston rod lug 134 pinned to lug 123 by pin 128.

Circular seals 135 provide fluid-tight sealing of the various parts throughout the drive assembly 126, including between the piston and the cylinder wall, and between the piston rod and the rod opening in cap 133.

An upper pressure supply and relief line 136 communicates through a fluid channel 138 in the top of cylinder flange 130 to the top side of piston 131 from a fluid pressure supply source (not shown) at the surface. Likewise, a pressure supply and relief line 137 is connected to channel 139 through cylinder cap 133, and is also connected to the pressure supply source at the surface. A four-way valve (not shown) controls the flow of hydraulic fluid to the drive assembly 126, allowing fluid under pressure to go into either one of the supply lines whichever is selected at the surface, while exhausting the opposite line to a reservoir of fluid. Thus, the piston can be moved upward or downward by hydraulic pressure placed above or below piston 131.

OPERATION OF SECOND EMBODIMENT

In typical operation, the drilling seal apparatus 100 is suspended in the borehole from the bottom of a drilling rig floor, and the drill pipe may be lowered through the seal to sealingly engage the upper and lower seal lips 109 and 118, respectively.

When a seal against the borehole wall is desired, pressurized actuating fluid is supplied through upper line 136 to the top of piston 131, driving the piston downward in the cylinder. Fluid below piston 131 is allowed to exit through lower line 137 to a fluid reservoir (not shown).

Downward movement of piston 131 and rod 132 moves sleeve 125 and compression ring 121 downward, compressing main-seal sleeve 120 downward and outward into engagement with the borehole wall. Maintenance of fluid pressure on the top of piston 131 results in continued engagement of seal 120 with the wellbore.

In order to remove the seal from the wellbore, hydraulic pressure may be switched from the upper line 136 to the lower line 137, driving piston 131 upward. The main-seal sleeve 120 will then be allowed to return to its natural, elongated configuration away from the wellbore. This disengagement can be further aided by bonding or otherwise attaching the top of seal sleeve 120 to compression ring 121, resulting in the resilient sleeve 120 being pulled upward into elongation by upward action of piston 131.

It should be noted that whereas one piston drive assembly 126 may be utilized in the apparatus, it would be preferable, in order to balance the compression forces, to utilize two or more of the drive assemblies connected in parallel to the fluid pressure supply source. Using a plurality of the drive assemblies is most effective when the drive assemblies are equally spaced about the periphery of the carrier sleeve 112. Each drive assembly would be pinned to corresponding sets of upper and lower lugs 122 and 123 equally spaced around the circular rings 111 and 124, respectively.

THIRD EMBODIMENT

Figures 4, 4A, 4B:
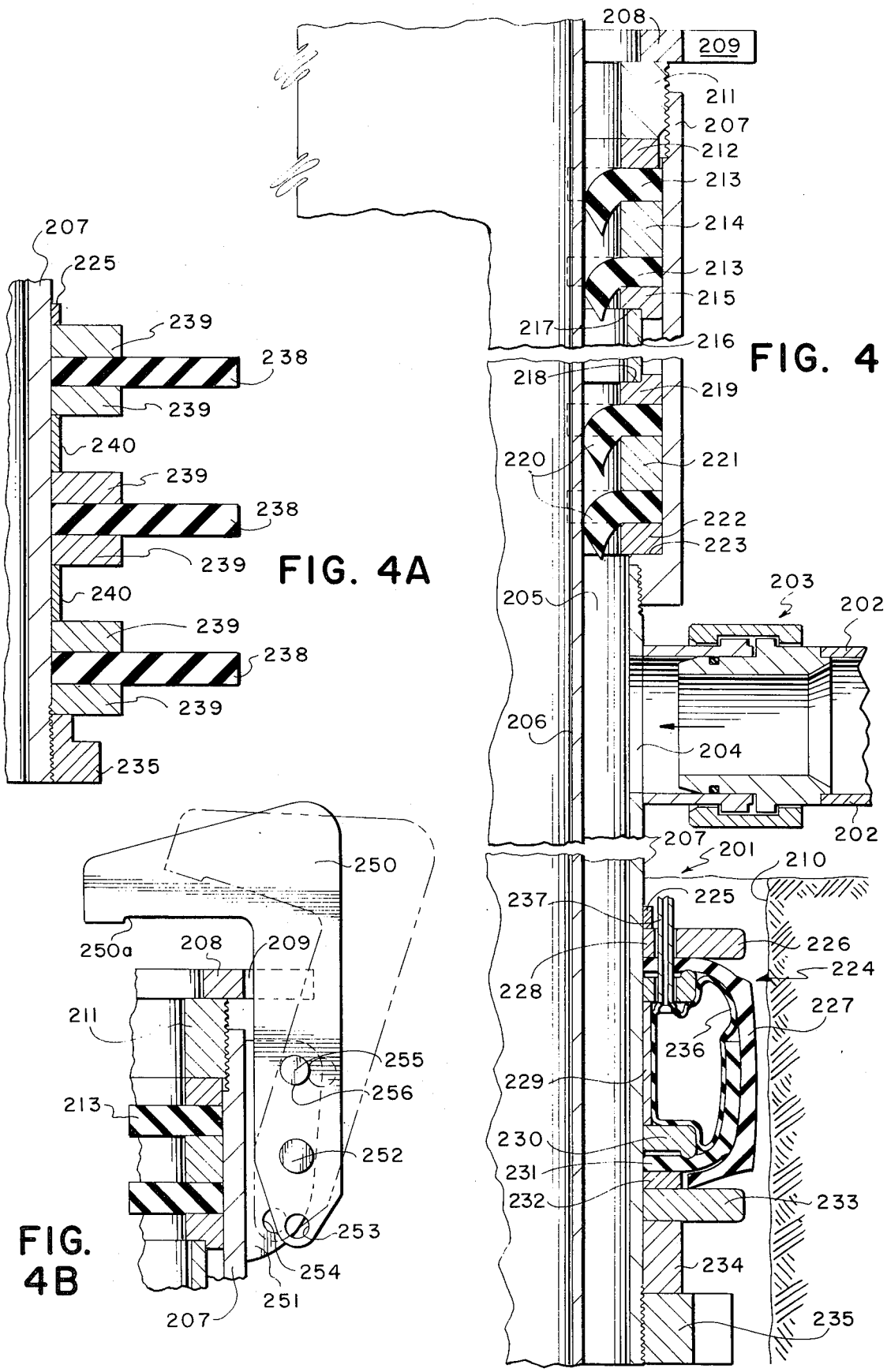
FIG. 4 shows in cross-section a one-half view of another embodiment of the inflatable sealing apparatus.
FIG. 4A shows an alternate embodiment for a portion of the apparatus of FIG. 4; and, FIG. 4B shows a side view of a latching mechanism.

Referring now to FIGS. 4, 4A, and 4B, a drilling seal 201 is illustrated which is particularly advantageous for use in either a cased or open borehole. In this instance, air is supplied through an air supply conduit 202, latch fitting 203, and port 204 to the annular area 205 between the drill pipe 206 and the tubular housing 207.

The seal assembly 201 is suspended in a borehole 210 by a strut (not shown) extending from the drilling rig floor. A circular latch ring 208 having one or more radial slots 209 is fixedly attached to an externally threaded clamp nut 211. The clamp nut is an annular ring threaded into the upper end of the tubular housing 207 in abutment with an annular abutment ring 212. A plurality of resilient annular lip seals 213 are clamped in place by abutment ring 212, a central spacer ring 214, and lower abutment ring 215.

A cylindrical spacer sleeve 216 seats in a lower groove 217 of ring 215 and a corresponding groove 218 of lower seal assembly abutment ring 219. The lower seal assembly has a plurality of annular resilient seal lips 220 held in place by the clamping action of upper abutment ring 219, spacer ring 221, and lower abutment ring 222 which is abutted against an annular internal shoulder 223 of housing 207.

The drill pipe location is illustrated in conjunction with lower lip seals 220 to show the flexed configuration of the seals when the sealing assembly is in place around a drill pipe. The unflexed positions of seals 220 are shown in phantom in the figure.

The inflatable seal assembly 224 is located circumferentially about the housing 207 and is for the most part slidably mounted thereon. A stop ring 225 is fixedly attached to the housing by means such as welding. The remaining components are assembled on the housing by sliding them on from the bottom. An annular seal plate 226 is abutted against stop ring 225. A stiff elastomeric annular boot 227 is clamped against plate 226 by clamp ring 228 which is abutted in turn by spacer sleeve 229, clamp ring 230, elastomeric boot 231, spacer ring 232, flat circular plate 233, abutment sleeve 234, and adjustment nut 235 which is threaded onto the lower end of housing 207.

A highly resilient, inflatable, annular bladder 236 is enclosed by annular boots 227 and 231 and has an inflation stem 237 extending outward through aligned openings in ring 228, boot 227, and plate 226. Stem 237 is connected to an external air supply source and is inflated to expand boots 227 and 231 outward to engage the borehole wall. Boots 227 and 231 are arranged to slide against each other to allow their expansion outward against the borehole.

FIG. 4A illustrates an alternate embodiment to seal assembly 224 and comprises a plurality of resilient annular lip seals 238 held in clamped relationship on housing 207 by abutment of rings 239, spacers 240, and lower adjustment nut 235 with each other and upward abutment of the assembly against stop ring 225. Lip seals 238 provide sealing engagement with the casing or the borehole wall, whichever the case may be.

FIG. 4B illustrates a latch cog 250 for easy removal of the drilling seal assembly 201 (FIG. 4) from the wellbore. Since the engagement of the seal assembly in the bore may cause indentations in the underground formation and the sealing elements may become embedded in the ground, it may be physically difficult to manually lift the seal assembly out of the borehole when desired. Referring also to the typical drill pipe joint with which this assembly is advantageously used, as shown in FIG. 1B, the advantages of the latch cog are readily apparent.

A pair of parallel spaced hinge plates 251 are fixedly attached to the outer surface of the upper portion of housing 207. An angular latch cog 250 is rotatably hinged between the two plates 251 by swing pin 252. The two positions of the latch cog are shown in the figure, with the latch position being shown in solid lines and the unlatched position shown in phantom. The location of plates 251 is selected to allow the cog to swing with no interference into slot 209 of latch ring 208. Engagement in slot 209 allows extension of the angular head 250*a* of the latch cog to extend radially inward to engage flange 33' (FIG. 1B). The sides of slot 209 also supply lateral support to cog 250 to aid in preventing the cog from being twisted laterally out of engagement with the pipe joint.

The cog 250 is held out of engagement, in the position illustrated in phantom lines, by placement of a lockout pin (not shown) through hole 253 in the cog and through holes 254 in the hinge plates 251.

Similarly, the cog is held in the engaging position, illustrated by the solid lines in the figure, by the placement of a lock-in pin 255 through hole 256 in the cog and holes in the plates laterally aligned with hole 256.

When it is desirable to remove the drilling seal assembly from the well along with the drill pipe, the lockout pin is removed and the latch cog is swung into the flange area of a drill pipe joint as shown in FIG. 1B, and the lock-in pin is inserted in hole 256 and the aligned hinge-plate holes. Upward lifting of the drill pipe by the surface lifting equipment also simultaneously pulls the seal assembly from the borehole and, when completely free of the hole, the seal assembly can be easily removed from the drill pipe.

For convenience, the lockout holes 253 and the lock-in holes can be made the same size so that the same pin can be used for both modes of operation. Also one latch cog is sufficient to remove the seal assembly but a more efficient removal can be obtained using two or more cogs equally spaced on the seal assembly.

Although specific preferred embodiments of the present invention have been described in the detailed description above, the description is not intended to limit the invention to the particular forms or embodiments disclosed herein since they are to be recognized as illustrative rather than restrictive, and it would be obvious to those skilled in the art that the invention is not so limited. For example, where annular flow spaces are defined in the invention, it is clear that a plurality of flow tubes could be substituted for the annular flow space. Conversely, where flow tubes are defined it is possible to utilize an annular flow space instead. Thus, the invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. An independent seal assembly for placement in an annulus between a rotatable drillpipe and a borehole and arranged for sealing engagement therewith, said seal assembly comprising:

generally cylindrical tubular housing means adapted for telescopic placement over a drillpipe into a well bore annulus;

inner resilient seal means inside said housing means arranged for sealingly and circumferentially contacting the drillpipe;

outer resilient seal means on said housing means adapted to circumferentially sealingly engage the borehole wall;

wherein said inner resilient seal means comprises one or more resilient circular rings attached to said housing means and arranged to contact the drillpipe in flexed sealing relationship; and, latch means attached to said housing means and adapted to latch to the drillpipe upon upward movement thereof, said latch means comprising one or more hinged angular cogs arranged to be selectively rotated into engagement with discontinuities on the drillpipe outer surface.

2. Apparatus for sealing the annulus between a borehole and a drillpipe wherein a compressed fluid is utilized to carry drill cuttings from the borehole up the drillpipe, said apparatus comprising:

a generally cylindrical tubular housing arranged to fit concentrically between a borehole and drill pipe therein;

annular resilient lip seal means attached to the inside of said housing above the ground surface;

fluid passage means through said housing above ground surface, below said lip means, and adapted to provide fluid passage to the annular area between said housing and the drillpipe;

lower annular seal means attached externally to said housing and arranged to engage the borehole wall in sealing contact; and, latch means on said housing, said latch means adapted to be selectively moved into latching engagement with the drillpipe.

3. The apparatus of claim 2 wherein said latch means comprises angular cog means hingedly attached to said housing and arranged to be releasably locked in either one of two positions; with one said position being a drill pipe engaging position, and the other said position being a non-engaging position with respect to the drill pipe.

* * * * *